US007147142B1

(12) United States Patent
Chang

(10) Patent No.: US 7,147,142 B1
(45) Date of Patent: Dec. 12, 2006

(54) EXTENDIBLE ACCORDION-LIKE FILE

(76) Inventor: Jui Yang Chang, No. 185, Minjh Road, Chinshui Town, Taichung Hsien 43651 (TW)

( * ) Notice: Subject to any disclaimer, the term of this patent is extended or adjusted under 35 U.S.C. 154(b) by 0 days.

(21) Appl. No.: 11/338,941

(22) Filed: Jan. 25, 2006

(30) Foreign Application Priority Data

Jul. 22, 2005 (CN) ..... 2005 2 0061585

(51) Int. Cl.
*B65D 27/00* (2006.01)

(52) U.S. Cl. ..... 229/67.3; 206/425; 229/67.4

(58) Field of Classification Search ..... 206/425; 229/67.1–67.4, 928; 402/70, 73
See application file for complete search history.

(56) References Cited

U.S. PATENT DOCUMENTS 2,519,405 A * 8/1950 Schwinger ..... 229/67.3
5,064,069 A 11/1991 Su ..... 206/425
5,271,502 A 12/1993 Chang ..... 206/425
5,593,086 A 1/1997 Ho ..... 229/67.3
5,630,509 A * 5/1997 Su ..... 206/425
5,664,724 A * 9/1997 Ho ..... 229/67.4
6,431,357 B1 8/2002 Su ..... 206/425
6,558,063 B1 * 5/2003 Ho ..... 402/73
6,945,399 B1 * 9/2005 Ong ..... 206/425

* cited by examiner

*Primary Examiner*—Luan K. Bui
(74) *Attorney, Agent, or Firm*—Charles E. Baxley

(57) ABSTRACT

An accordion-like file includes a rear panel having a folded base panel, a front panel having a folded bottom panel movable toward and away from the base panel of the rear panel, an expandable connecting member disposed between the rear panel and the front panel, and a coupling panel for adjustably coupling the bottom panel of the front panel and the base panel of the rear panel together, and for guiding and for limiting the front panel to slide relative to the rear panel. The coupling panel includes one or more grooves, and the front and the rear panels each includes one or more fasteners slidably engaged in the grooves of the coupling panel for guiding and for limiting the front and the rear panels to slide relative to the coupling panel.

11 Claims, 15 Drawing Sheets

EXTENDIBLE ACCORDION-LIKE FILE

BACKGROUND OF THE INVENTION

1. Field of the Invention

The present invention relates to an accordion-like file, and more particularly to an extendible accordion-like file having a front panel and a rear panel movable or adjustable relative to each other for allowing envelopes or expandable connecting members and document to be suitably disposed and retained between the front panel and the rear panel.

2. Description of the Prior Art

Typical accordion-like files comprise a bag having a base panel, two expandable connecting members disposed above the base panel for forming a gap between the bottom of the expandable connecting members and the base panel. Normally, the base panel is solidly secured to a front panel or a rear panel and foldable relative to the front panel and the rear panel only.

For example, U.S. Pat. No. 5,064,069 to Su, U.S. Pat. No. 5,271,502 to Chang, U.S. Pat. No. 5,593,086 to Ho, and U.S. Pat. No. 6,431,357 to Su disclose four of the typical accordion-like files each comprising a base panel coupled to the front panel or the rear panel and foldable relative to the front panel and the rear panel for adjustably receiving expandable connecting members or envelopes and document between the front panel and the rear panel.

However, the base panel includes a number of segments or bars foldable relative to each other, such that the distance between the front panel and the rear panel may only be determined by the length or width of the segments or bars, or the front panel and the rear panel may not be micro-adjusted relative to each other, such that the envelopes or expandable connecting members and document also may not be suitably or adjustably and snugly disposed and retained between the front panel and the rear panel.

The present invention has arisen to mitigate and/or obviate the afore-described disadvantages of the conventional accordion-like files.

SUMMARY OF THE INVENTION

The primary objective of the present invention is to provide an extendible accordion-like file including a front panel and a rear panel movable or adjustable relative to each other for allowing envelopes or expandable connecting members and document to be suitably disposed and retained between the front panel and the rear panel when the thickness or the width of the envelopes or the expandable connecting member and the document is either increased or decreased.

In accordance with one aspect of the invention, there is provided an accordion-like file comprising a rear panel including a bottom portion, and including a base panel folded and extended forwardly from the bottom portion of the rear panel, a front panel including a bottom portion, and including a bottom panel folded and extended rearwardly from the bottom portion of the front panel, the bottom panel of the front panel being movable toward and away from the base panel of the rear panel, an expandable connecting member disposed between the rear panel and the front panel, and a coupling device for adjustably coupling the bottom panel of the front panel and the base panel of the rear panel together, and for guiding and for limiting the front panel to slide relative to the rear panel and for allowing the expandable connecting member and the document to be expandably or adjustably and suitably received and retained between the front panel and the rear panel when the thickness or the width of the expandable connecting member and the document is either increased or decreased.

The coupling device includes a coupling panel slidably coupled to the bottom panel of the front panel. The coupling panel includes at least one groove formed therein, and the front panel includes at least one fastener attached to the bottom panel and slidably engaged in the groove of the coupling panel for guiding and for limiting the front panel to slide relative to the coupling panel.

The coupling panel includes at least one notch formed therein, and the front panel includes at least one fastener attached to the bottom panel and engageable into the notch of the coupling panel for aligning or guiding the front panel to slide relative to the coupling panel.

The front panel includes at least one end flap folded and engaged onto an end portion of the bottom panel for forming a gap between the end flap and the end portion of the bottom panel and for slidably receiving the coupling panel.

The coupling panel includes at least one groove formed therein, and the rear panel includes at least one fastener attached to the base panel and slidably engaged in the groove of the coupling panel for guiding and for limiting the rear panel to slide relative to the coupling panel.

The coupling panel includes at least one notch formed therein, and the rear panel includes at least one fastener attached to the base panel and engageable into the notch of the coupling panel for aligning or for guiding the rear panel to slide relative to the coupling panel.

The rear panel includes at least one end flap folded and engaged onto an end portion of the base panel for forming a gap between the end flap and the end portion of the base panel and for slidably receiving the coupling panel.

An anchoring strap includes a base portion secured to the rear panel, a foldable portion foldable relative to the base portion, a buckle attached to the foldable portion of the anchoring strap, and a fastening strap includes a base segment secured to the rear panel, a fastening device attached to the fastening strap, and a fastening segment engageable through the buckle and foldable and engageable with the fastening device for securing the rear panel to the front panel, and for retaining the expandable connecting member between the rear panel and the front panel.

The front panel includes a slot, the base segment of the fastening strap is engaged through the slot of the front panel and secured to the rear panel. A handle includes a slit for slidably receiving the anchoring strap and for slidably attaching the handle onto the anchoring strap and for allowing the handle to be adjusted relative to the anchoring strap according to the weight or the width of the envelopes or the expandable connecting member and the document.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
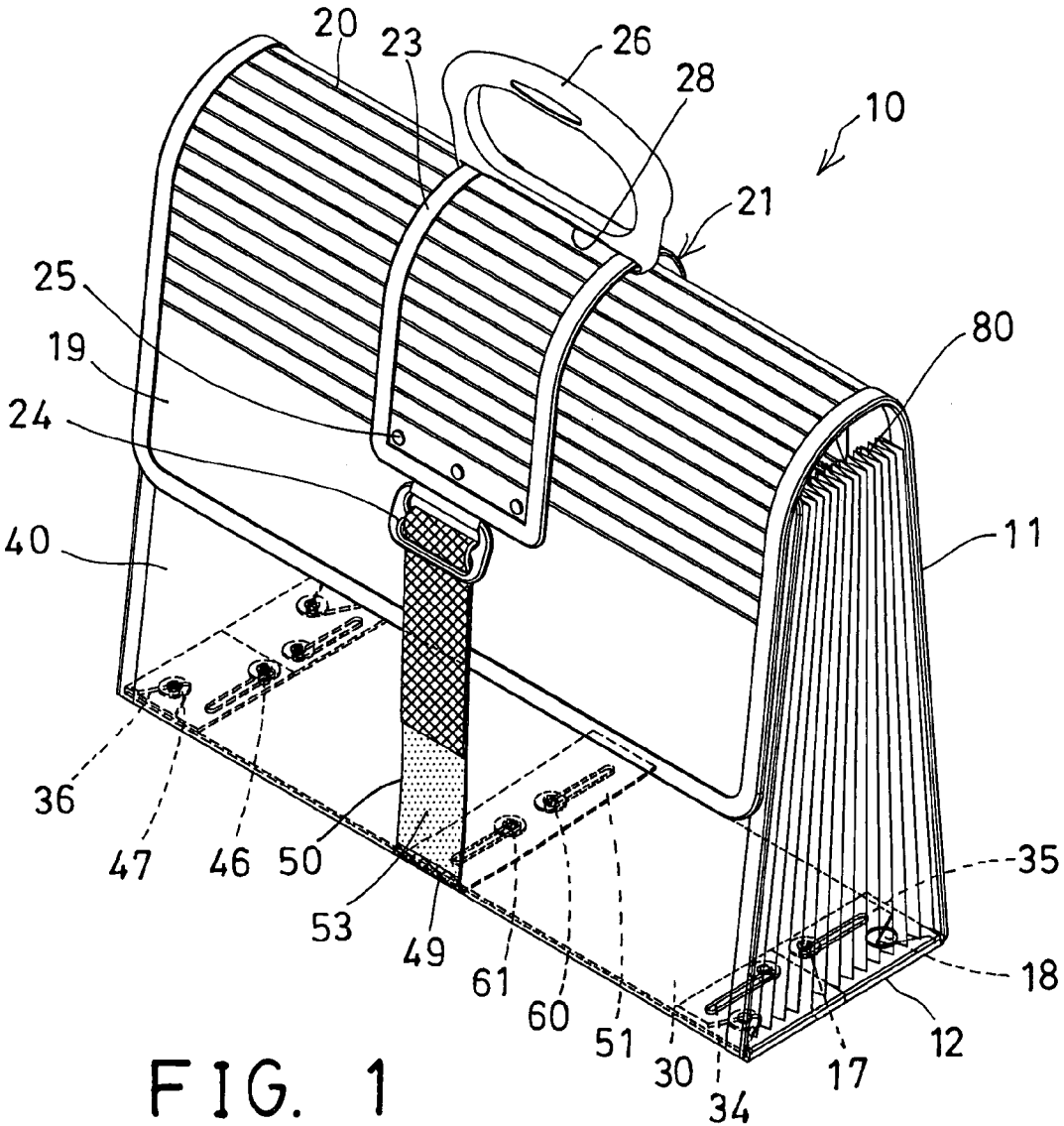
FIG. 1 is a front perspective view of an accordion-like file in accordance with the present invention.
Figure 2:
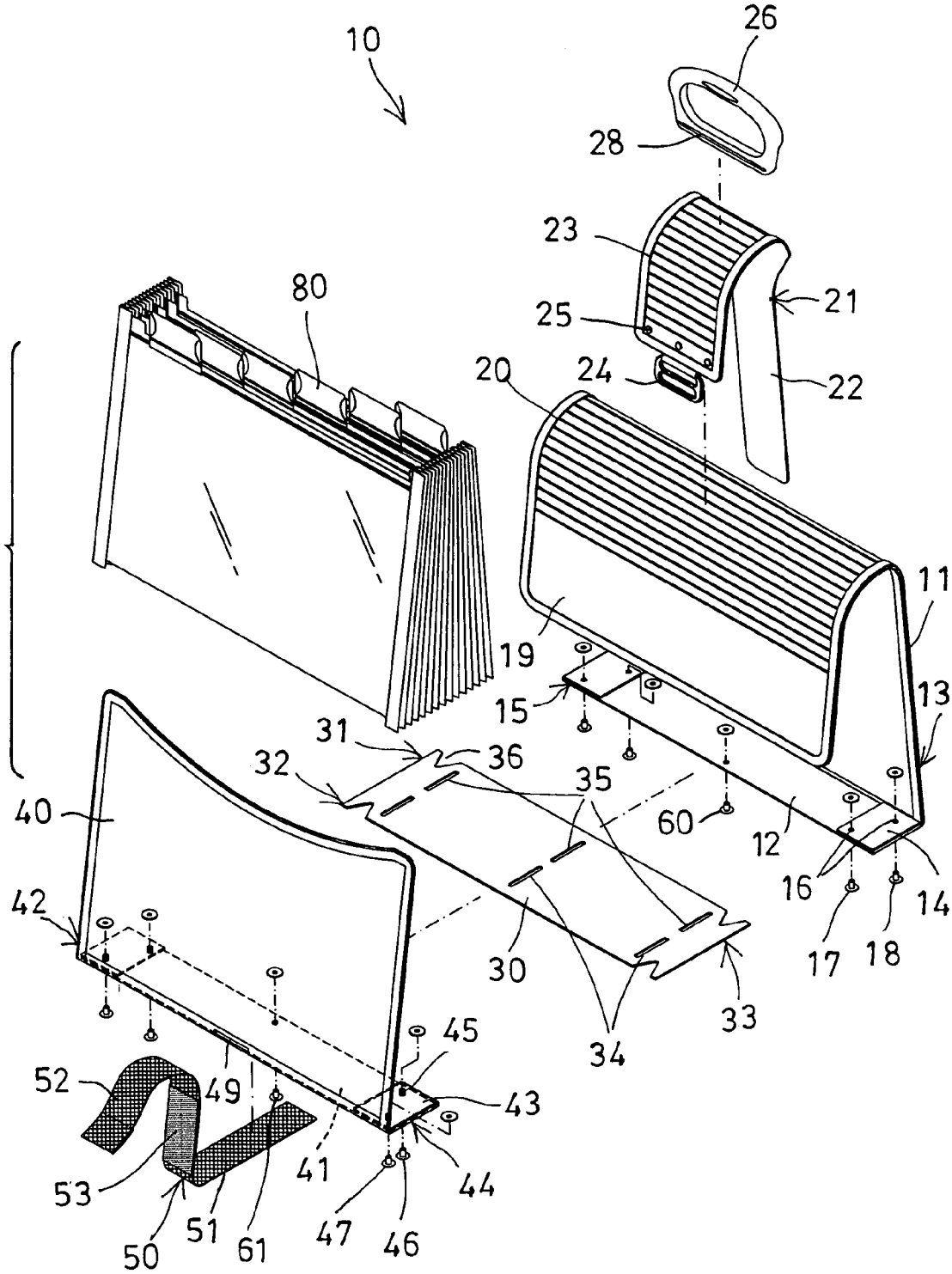
FIG. 2 is a partial exploded view of the accordion-like file.
Figure 3:
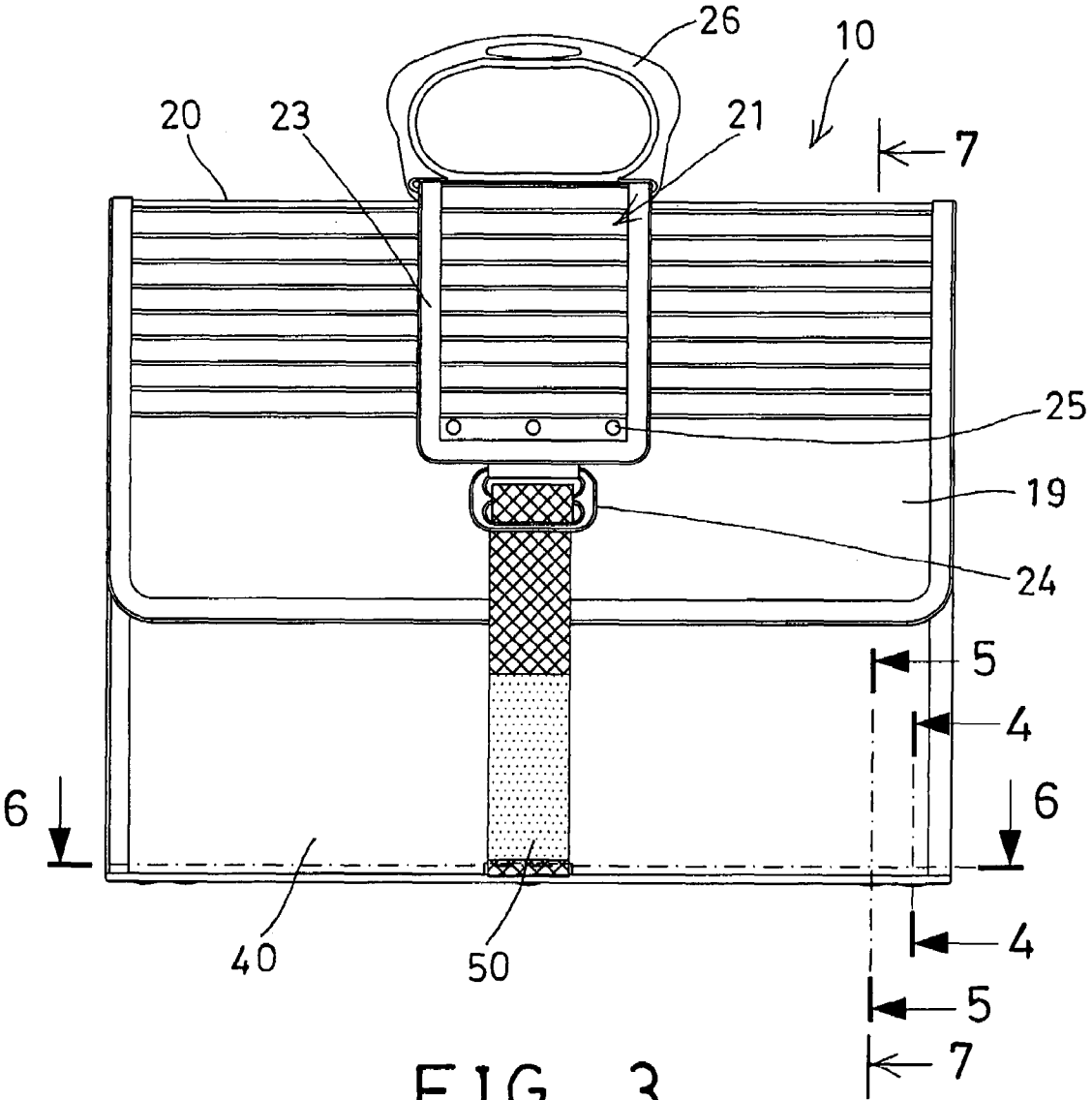
FIG. 3 is a front plan view of the accordion-like file.

Referring to the drawings, and initially to FIGS. 1–7, an accordion-like file 10 in accordance with the present invention comprises a rear panel 11 including a base panel 12 folded and extended forwardly from a bottom portion 13 of the rear panel 11, and including two end flaps 14 folded and engaged onto the end portions 15 of the base panel 12 and secured to the end portions 15 of the base panel 12 each of which includes one or more holes 16 formed therein for receiving fasteners 17, 18, it is preferable that the fasteners 17 are located closer to each other or in a relatively inner portion of the base panel 12 and located farther away from the rear panel 11, and the other fasteners 18 are located farther away from each other or in a relatively outer portion of the base panel 12 and located closer to the rear panel 11.

The rear panel 11 further includes an upper or front cover panel 19 provided on top of the rear panel 11 and foldable and extendible downwardly for covering purposes, the cover panel 19 includes a number of folding lines 20 formed or provided between the cover panel 19 and the rear panel 11, for facilitating the folding operation of the cover panel 19 relative to the rear panel 11. An anchoring strap 21 includes a body or base portion 22 secured to the back portion of the rear panel 11 with such as rivets, fasteners, latches (not shown) or the like, and a foldable portion 23 foldable relative to the base portion 22, and a buckle 24 attached or secured to the free end portion of the foldable portion 23 and/or of the anchoring strap 21 with such as rivets 25, fasteners, latches (not shown) or the like.

Figure 8:
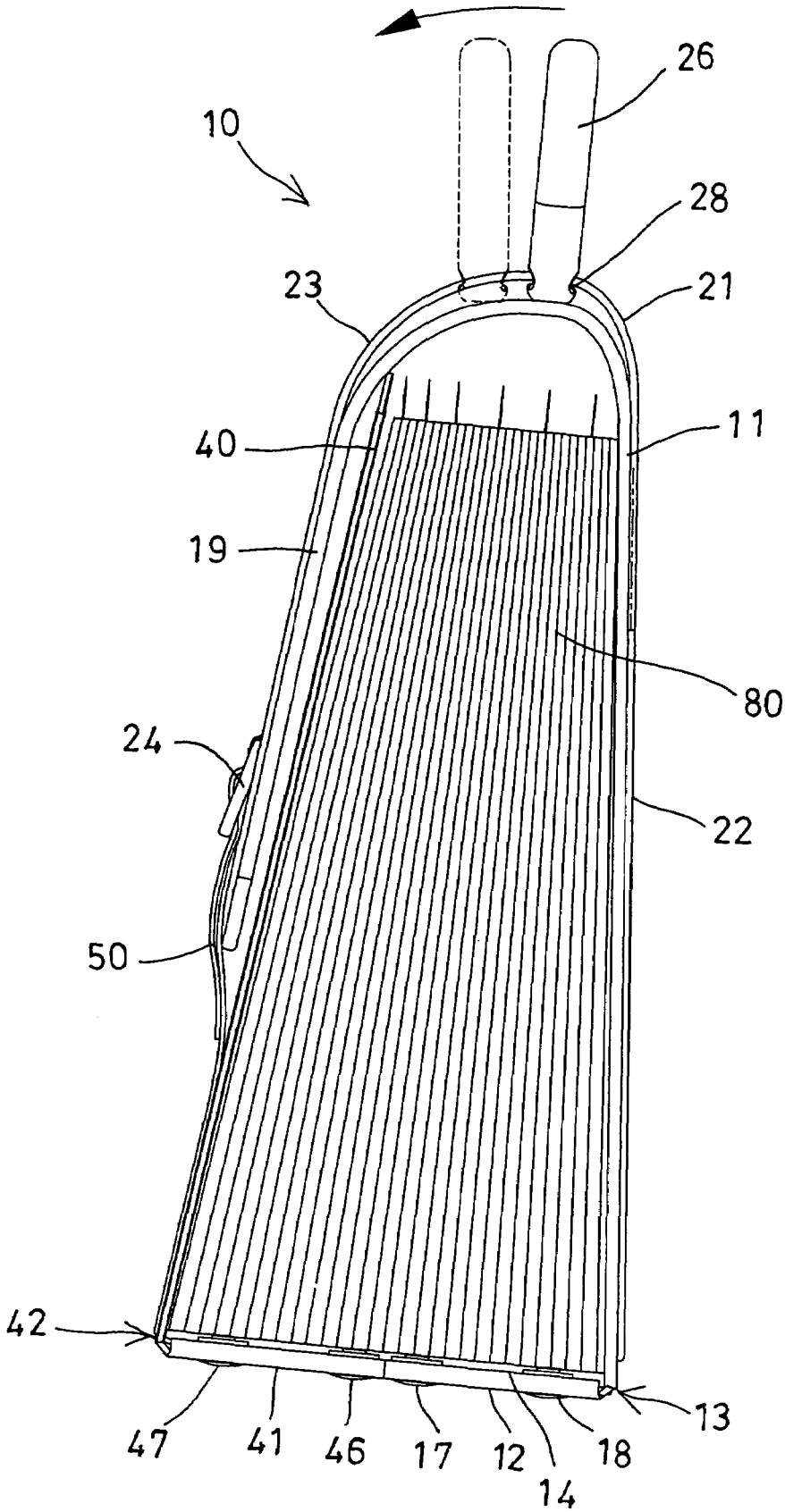
FIG. 8 is a side plan view of the accordion-like file.

A handle 26 includes a slit 28 formed therein, such as formed in the bottom portion thereof for slidably receiving the anchoring strap 21 and thus for slidably attaching the handle 26 onto the anchoring strap 21, and thus for allowing the handle 26 to be slid or adjusted relative to the anchoring strap 21, best shown in FIG. 8. A number of envelopes 80 or expandable connecting members 80 and document (not shown) are attached to the rear panel 11 and to be disposed and retained between the rear panel 11 and the cover panel 19. The document is arranged to be disposed or received within the envelopes 80 or expandable connecting members 80.

Figure 5:
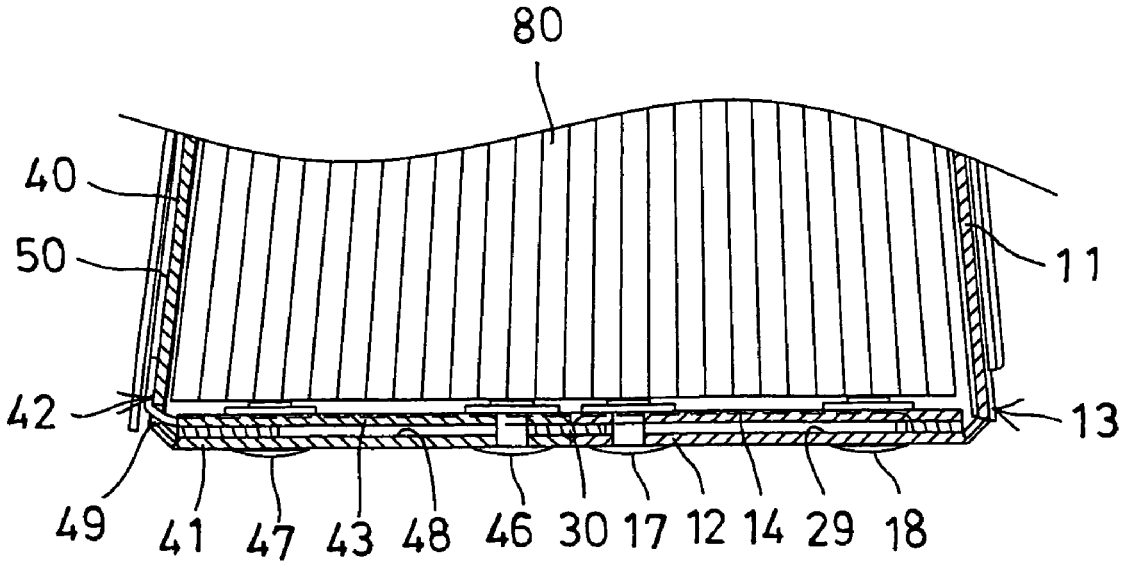
FIGS. 4, 5, 6, 7 are partial cross sectional views of the accordion-like file taken along lines 4—4, 5—5, 6—6, and 7—7 of FIG. 3 respectively.
Figure 4:
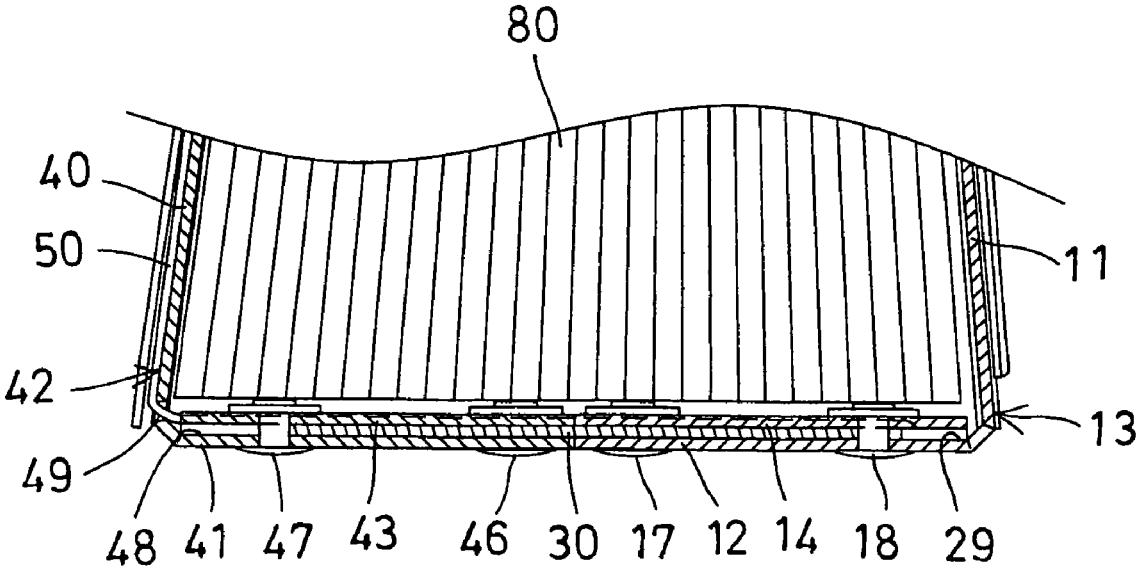

A coupling means or panel 30 includes a rear portion 31 located closer to the rear panel 11 and a front portion 32 located further away from the rear panel 11, and includes two end portions 33 slidably engaged into the gaps 29 that are formed or defined between the end flaps 14 and the end portions 15 of the base panel 12, best shown in FIGS. 4 and 5, and includes two or more grooves 34 formed in the front portion 32 thereof and two or more grooves 35 formed in the rear portion 31 thereof for slidably receiving the fasteners 17 and for guiding and for limiting the coupling panel 30 to slide relative to the rear panel 11 and the base panel 12.

Figure 6:
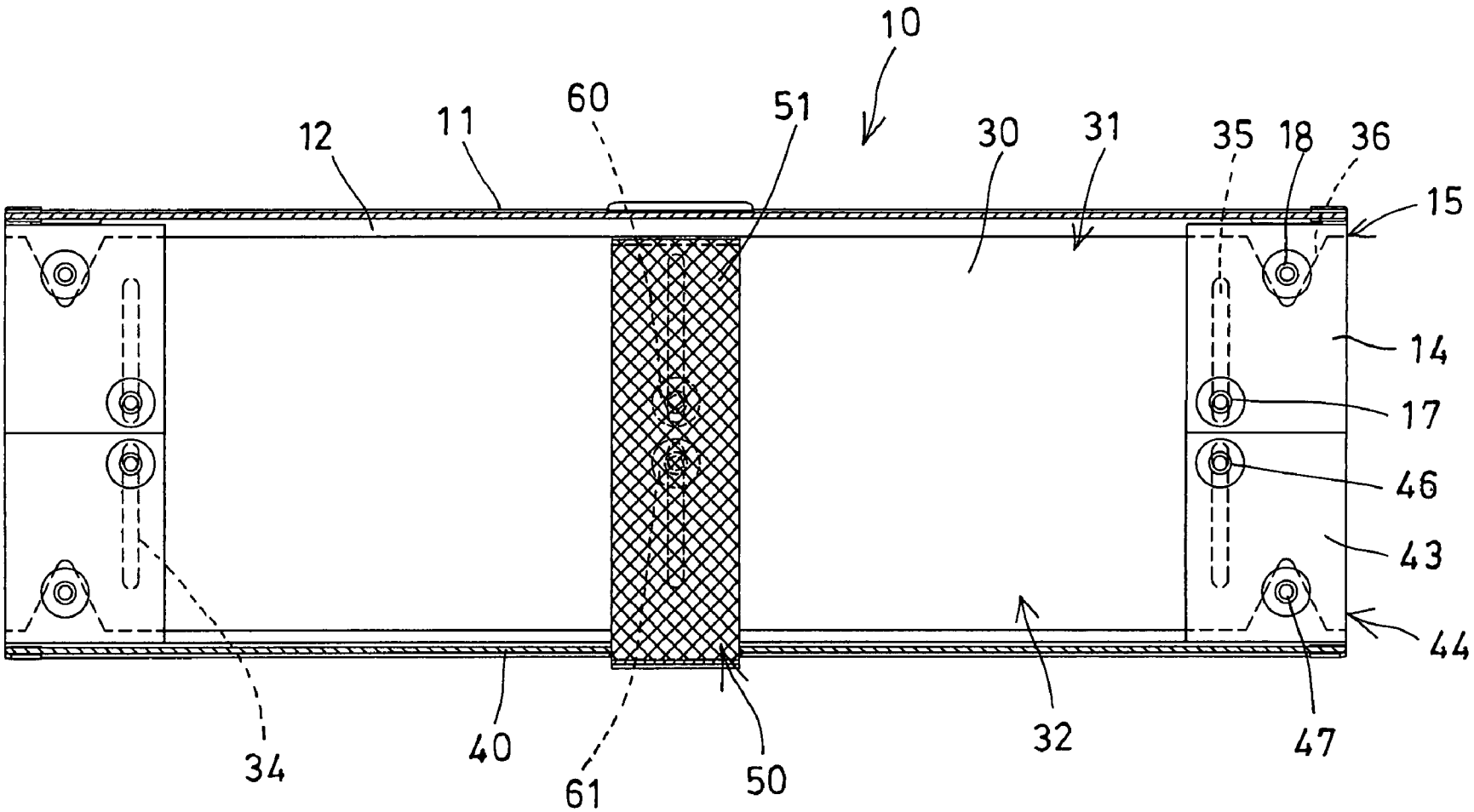
Figure 7:
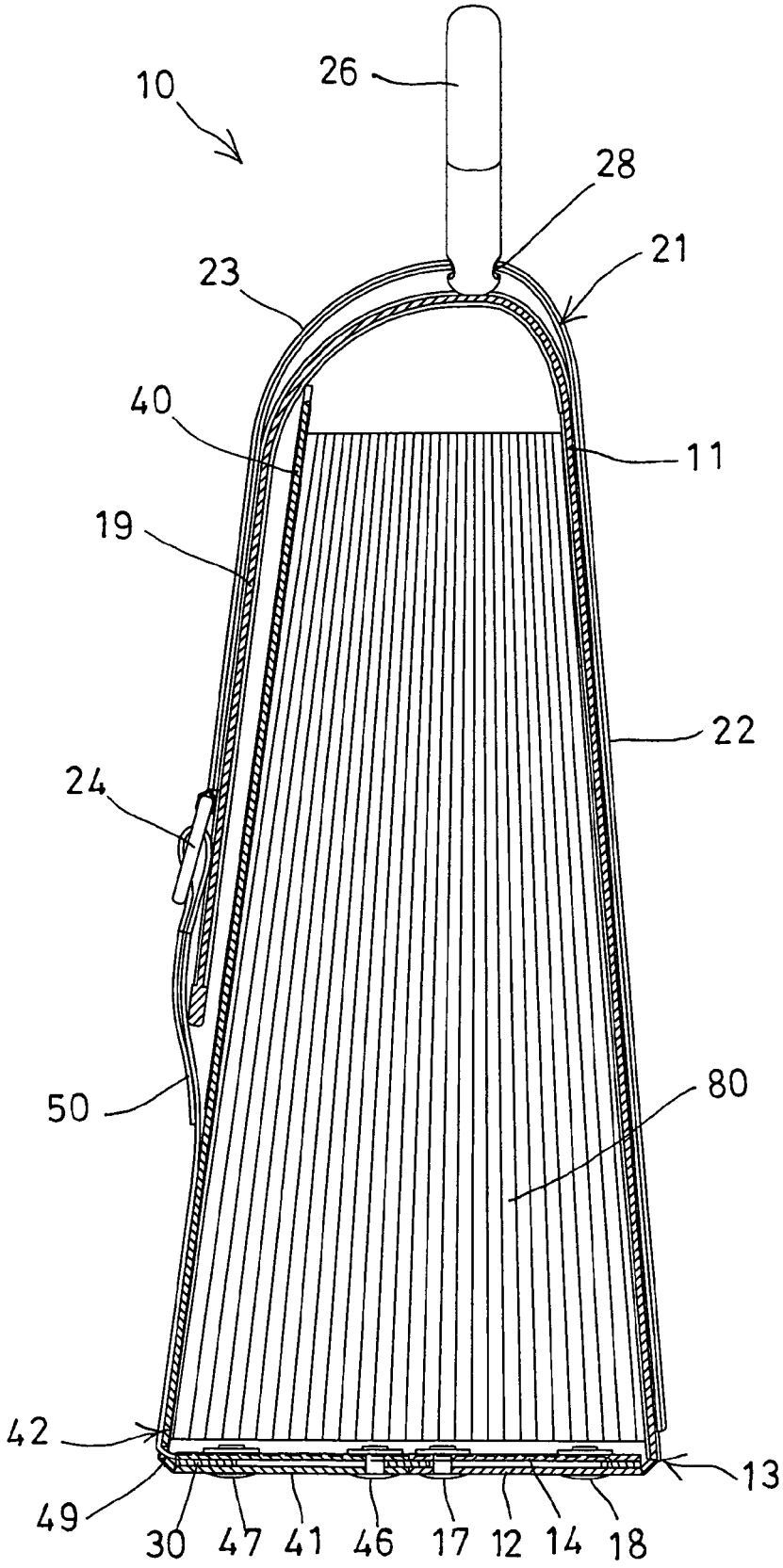

The coupling panel 30 further includes one or more notches 36, such as triangular notches 36 formed in either or both the front portion 32 and the rear portion 31 thereof for slidably receiving the other fasteners 18, best shown in FIGS. 1 and 6, and/or for further aligning and for guiding the coupling panel 30 to slide relative to the rear panel 11 and the base panel 12. The coupling panel 30 may thus be guided to slide toward or away from or relative to the rear panel 11 and the base panel 12 by the sliding movement of the two end portions 33 of the coupling panel 30 in the gaps 29 formed between the end flaps 14 and the end portions 15 of the base panel 12, and/or by the sliding movement of the fasteners 17 in the grooves 35 of the coupling panel 30.

The accordion-like file 10 further includes a front panel 40 having a bottom panel 41 folded and extended rearwardly from a bottom portion 42 of the front panel 40, and having two end flaps 43 folded and engaged onto the end portions 44 of the bottom panel 41 and secured to the end portions 44 of the bottom panel 41 each of which includes one or more holes 45 formed therein for receiving fasteners 46, 47, it is preferable that the fasteners 46 are located closer to each other or in a relatively inner portion of the bottom panel 41 and located farther away from the front panel 40, and the other fasteners 47 are located farther away from each other or in a relatively outer portion of the bottom panel 41 and located closer to the front panel 40. The envelopes 80 or expandable connecting members 80 are to be disposed and retained between the rear panel 11 and the front panel 40.

As also shown in FIGS. 4 and 5, two gaps 48 may also be formed or defined between the end flaps 43 and the end portions 44 of the bottom panel 41 respectively for slidably receiving the two end portions 33 at the front portion 32 of the coupling panel 30, and the fasteners 46 may also be slidably received in or along the grooves 34 of the coupling panel 30 for guiding and for limiting the coupling panel 30 to slide relative to the front panel 40 and the bottom panel 41. The other fasteners 47 may be slidably received or engaged into the notches 36, such as the triangular notches 36 of the coupling panel 30 for further aligning and for guiding the coupling panel 30 to slide relative to the front panel 40 and the bottom panel 41. The bottom panel 41 of the front panel 40 and the base panel 12 of the rear panel 11 may thus be guided to slide or to move relative to each other.

Figure 9:
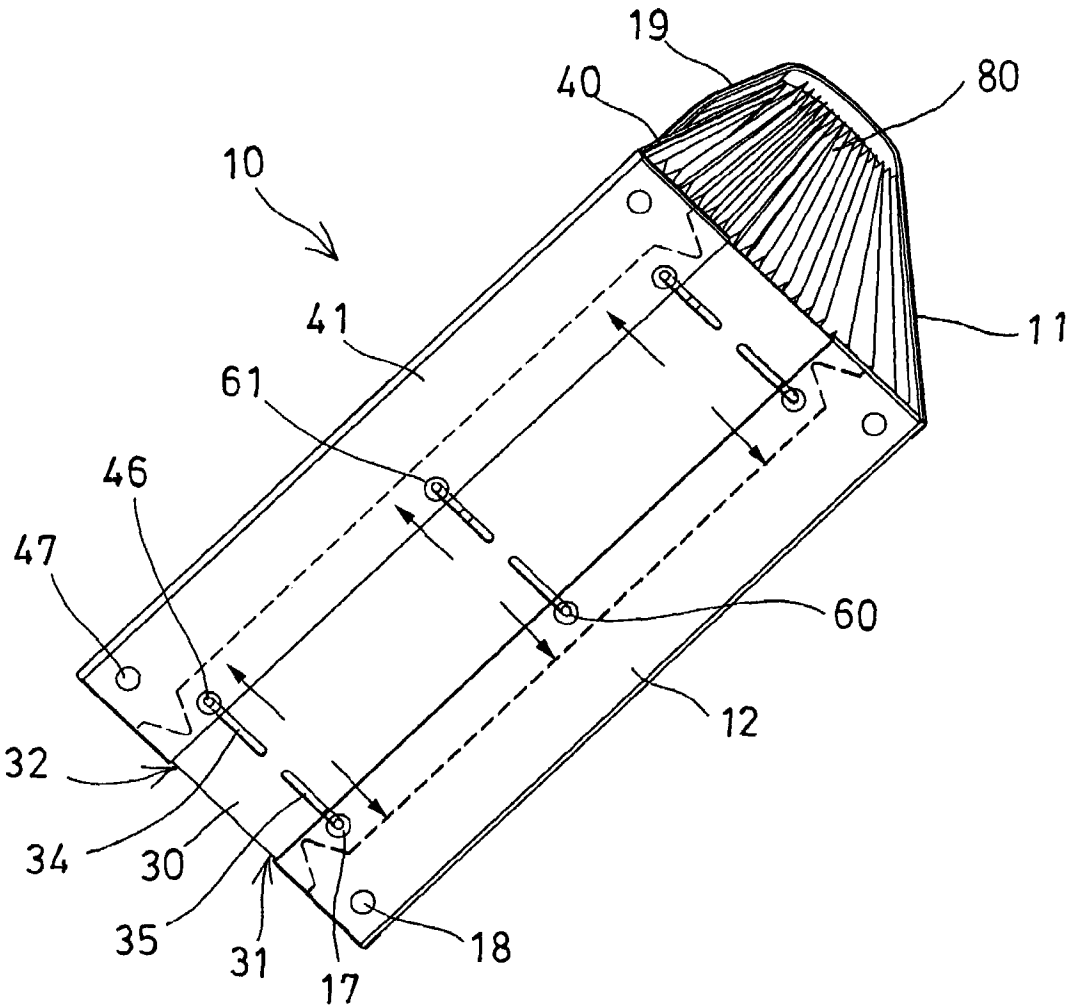
FIG. 9 is a bottom perspective view of the accordion-like file.
Figure 10:
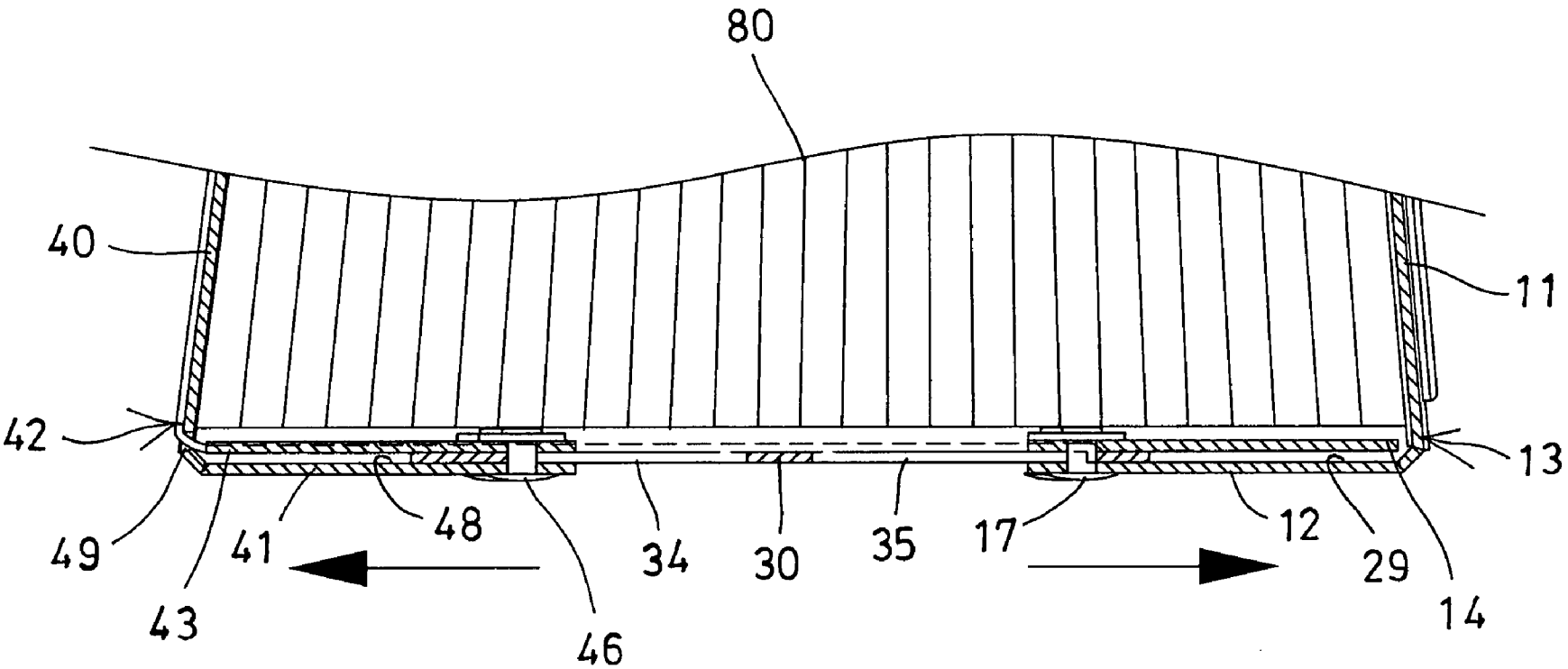
FIG. 10 is a partial cross sectional view similar to FIG. 5, illustrating the operation of the accordion-like file.
Figure 11:
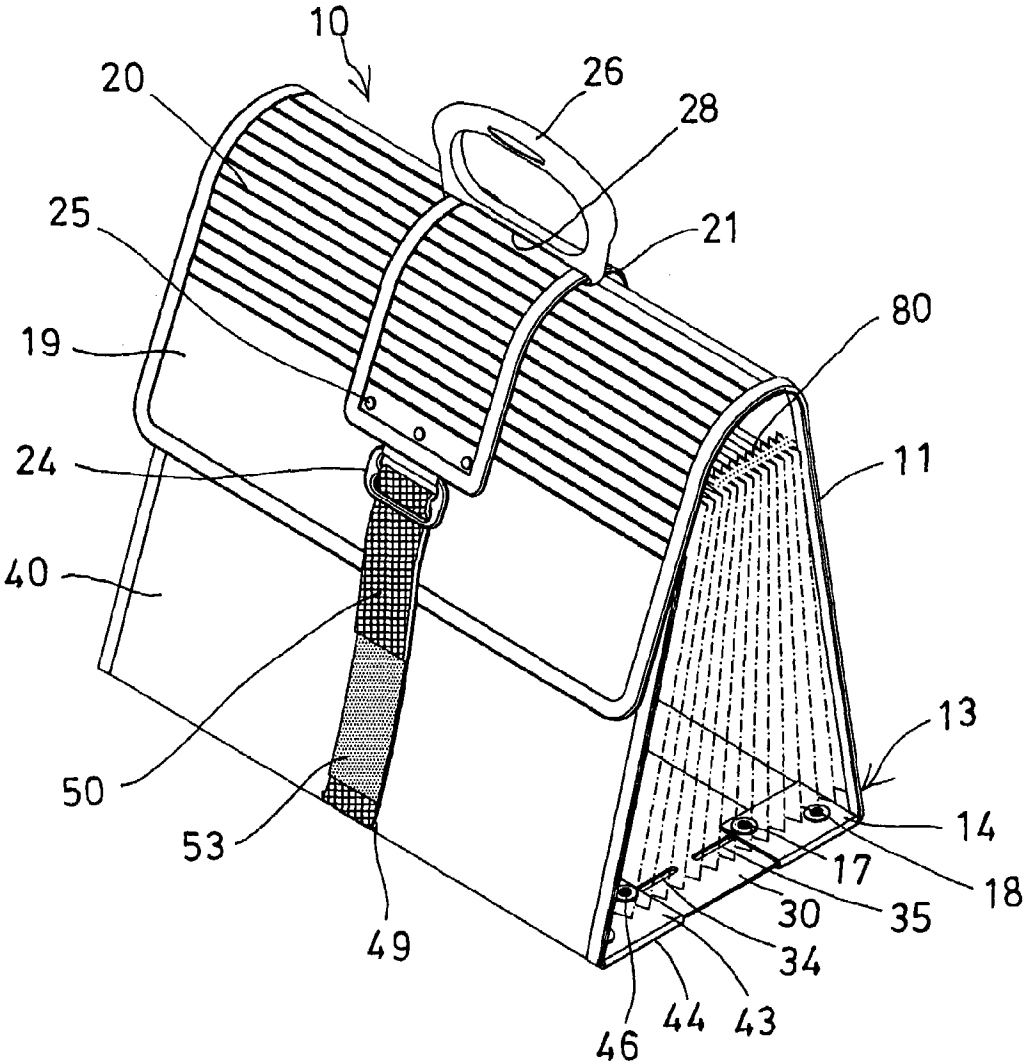
FIG. 11 is a front perspective view similar to FIG. 1, illustrating the operation of the accordion-like file.
Figure 12:
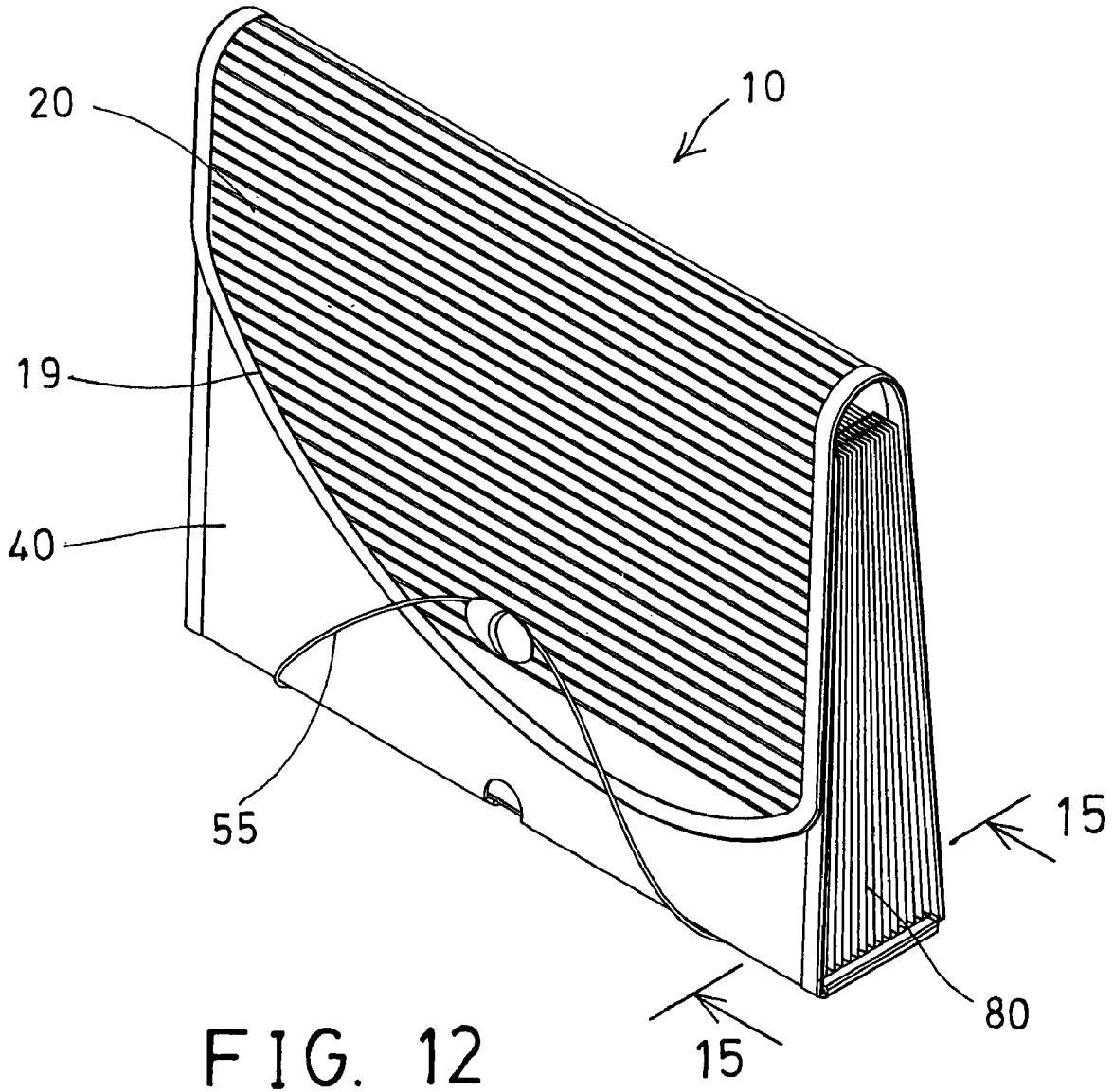
FIG. 12 is a front perspective view similar to FIG. 1, illustrating the other arrangement of the accordion-like file.
Figure 13:
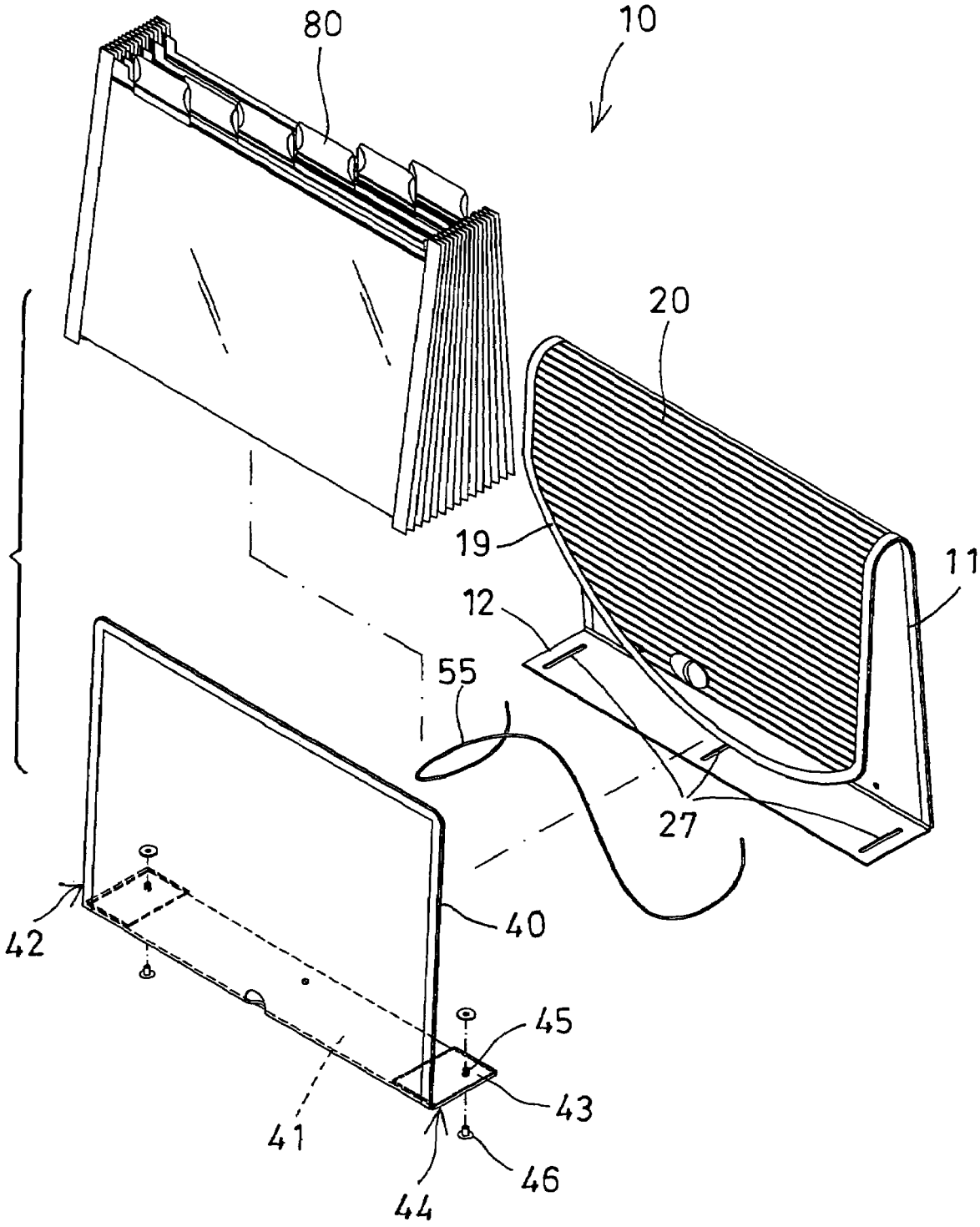
FIG. 13 is a partial exploded view of the accordion-like file as shown in FIG. 12.
Figure 14:
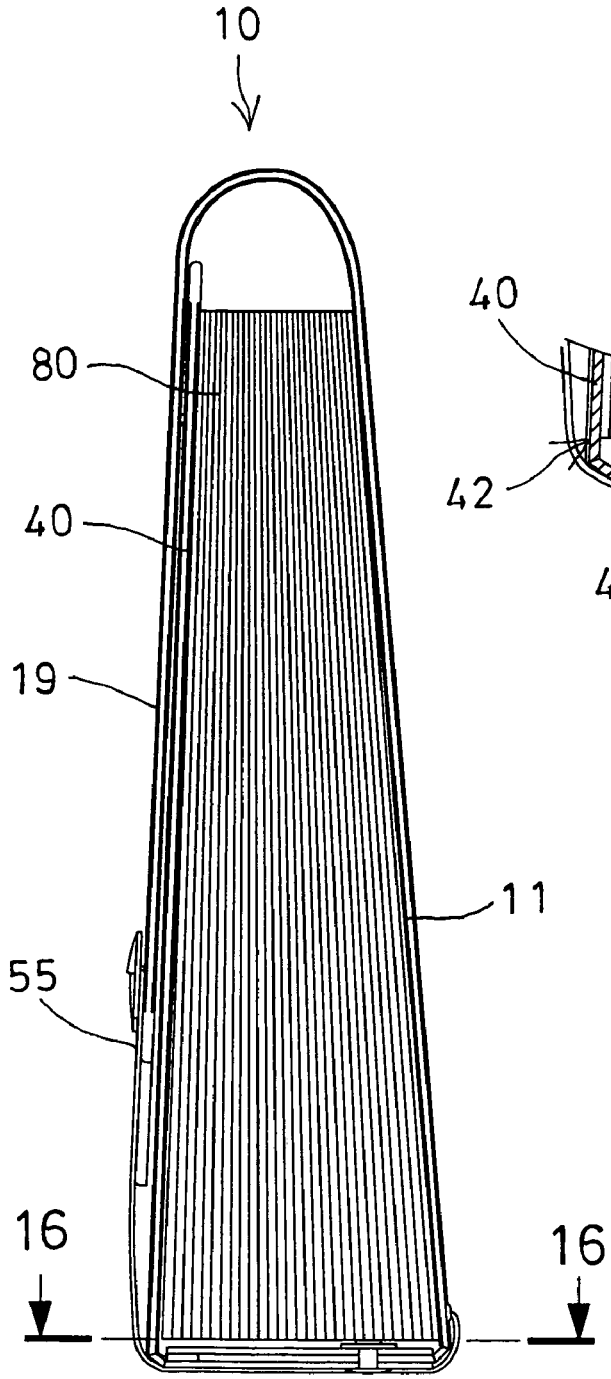
FIG. 14 is a side plan view of the accordion-like file as shown in FIGS. 12 and 13.
Figure 15:
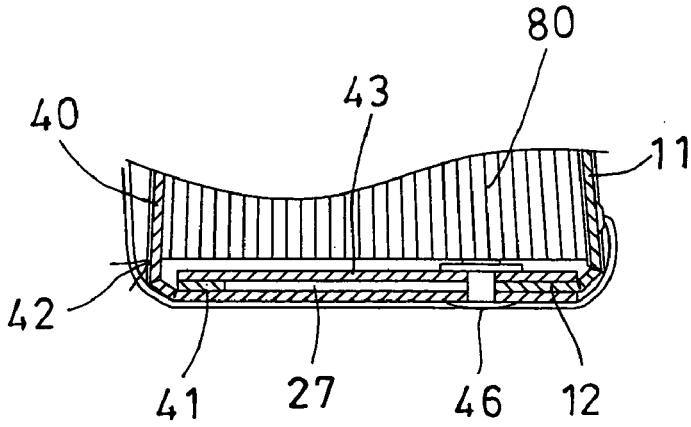
FIG. 15 is an enlarged partial cross sectional view of the accordion-like file taken along lines 15—15 of FIG. 12.
Figure 16:
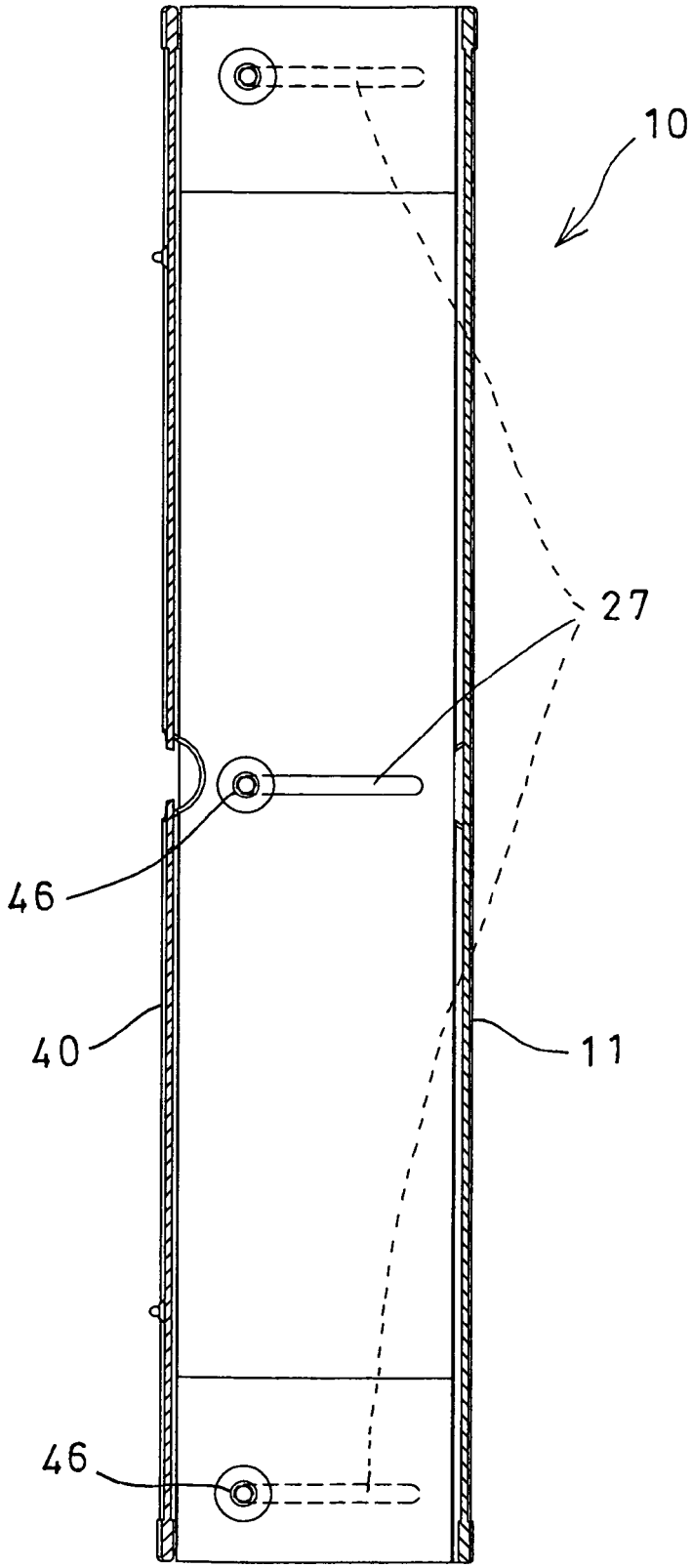
FIG. 16 is a cross sectional view of the accordion-like file taken along lines 16—16 of FIG. 14.
Figure 17:
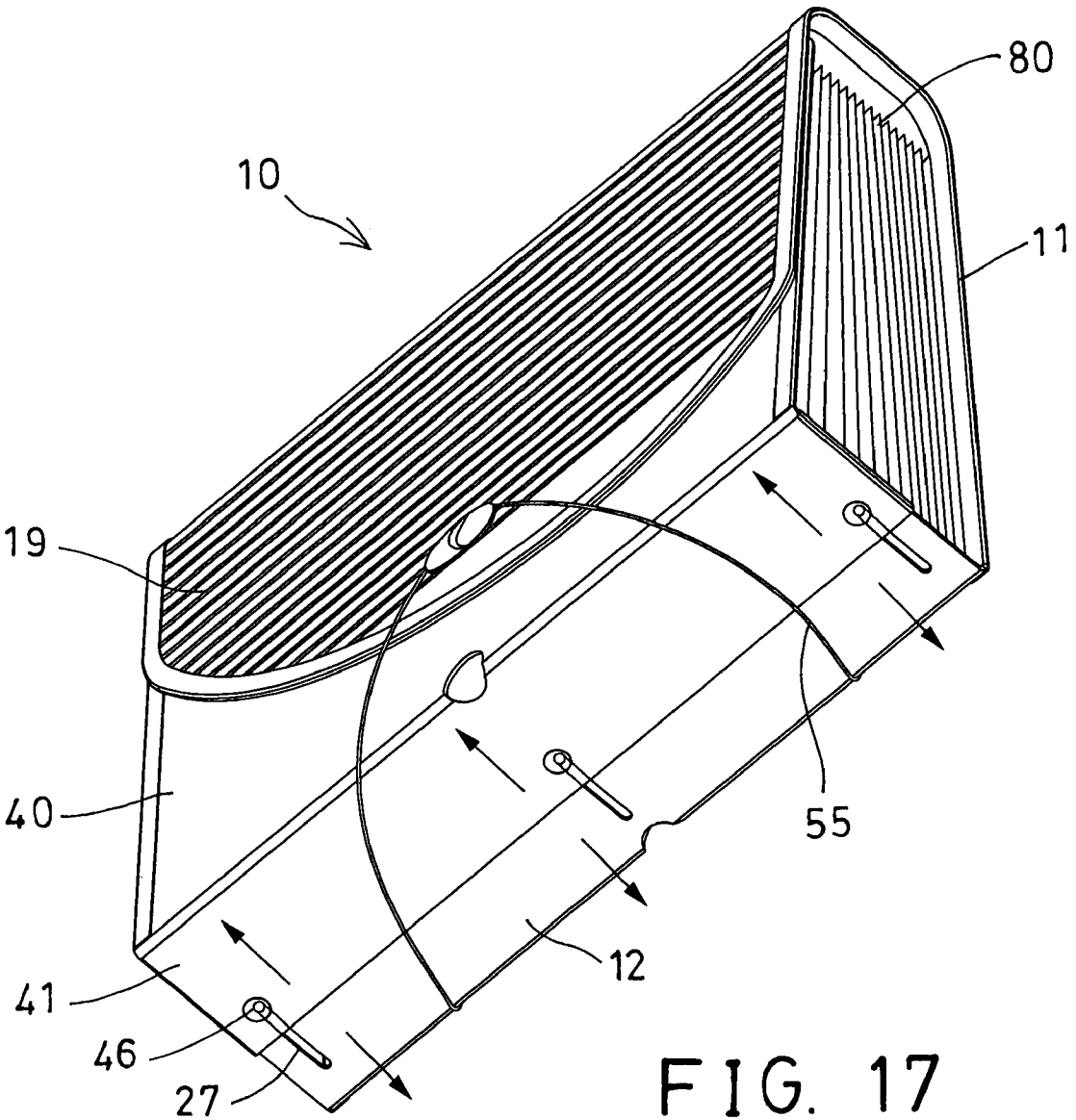
FIG. 17 is a bottom perspective view illustrating the operation of the accordion-like file as shown in FIGS. 12–16.

The coupling panel 30 may thus be guided to slide toward or away from or relative to the front panel 40 and the bottom panel 41 by the sliding movement of the two end portions 33 of the coupling panel 30 in the gaps 48 formed between the end flaps 43 and the end portions 44 of the bottom panel 41, and/or by the sliding movement of the fasteners 46 in the grooves 34 of the coupling panel 30. In operation, as shown in FIGS. 9–11, the front panel 40 and the rear panel 11 may be moved or adjusted toward each other or away from each other by the sliding movements of the fasteners 17, 46 in the grooves 35, 34 of the coupling panel 30 in response to the expansion of the envelopes 80 or expandable connecting members 80.

The typical or conventional accordion-like files failed to provide a front panel and a rear panel that may be moved or adjusted toward each other or away from each other. The accordion-like file 10 further includes a fastening strap 50 having a base segment 51 engaged through a slot 49 of the front panel 40 (FIGS. 2, 4–5) and secured to the rear panel 11 with such as rivets, fasteners, latches (not shown) or the like, and having a fastening segment 52 engageable through the buckle 24 and foldable and engageable with a hook-and-loop fastening device 53 (FIG. 1) for securing the rear panel 11 and the cover panel 19 to the front panel 40, and thus for solidly or suitably or adjustably retaining the envelopes 80 or expandable connecting members 80 between the rear panel 11 and the front panel 40.

The accordion-like file 10 may further include one or more fasteners or guide pins 60 attached or secured to the base panel 12 of the rear panel 11, and one or more fasteners or guide pins 61 attached or secured to the bottom panel 41 of the front panel 40 and slidably engaged into the grooves 35, 34 of the coupling panel 30 respectively for further guiding and limiting the coupling panel 30 to slide relative to the bottom panel 41 of the front panel 40 and the base panel 12 of the rear panel 11, and for preventing the middle portions of the bottom panel 41 of the front panel 40 and the base panel 12 of the rear panel 11 from being distorted or deformed.

Alternatively, as shown in FIGS. 12–16, without the coupling means or panel 30, the rear panel 11 may include one or more grooves 27 formed in the base panel 12 for slidably receiving the fasteners 46 of the front panel 40 and for guiding and for limiting the front panel 40 to slide relative to the rear panel 11 and the base panel 12, such that the fasteners 46 and/or the coupling panel 30 may be used or acted as a means for adjustably coupling the front panel 40 and the rear panel 11 together, and also for guiding and for limiting the front panel 40 to slide relative to the rear panel 11. A resilient coupling or fastening cable 55 may be provided for securing the rear panel 11 and the cover panel 19 to the front panel 40, and thus for solidly retaining the envelopes 80 or expandable connecting members 80 between the rear panel 11 and the front panel 40.

Accordingly, the extendible accordion-like file in accordance with the present invention includes a front panel and a rear panel movable or adjustable relative to each other for allowing a number of envelopes or expandable connecting members and document to be suitably disposed and retained between the front panel and the rear panel.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An accordion-like file comprising:

a rear panel including a bottom portion, and including a base panel folded and extended forwardly from said bottom portion of said rear panel, a front panel including a bottom portion, and including a bottom panel folded and extended rearwardly from said bottom portion of said front panel, said bottom panel of said front panel being movable toward and away from said base panel of said rear panel, an expandable connecting member disposed between said rear panel and said front panel, and means for adjustably coupling said bottom panel of said front panel and said base panel of said rear panel together, and for guiding and for limiting said front panel to slide relative to said rear panel.

2. The accordion-like file as claimed in claim 1, wherein said coupling means includes a coupling panel slidably coupled to said bottom panel of said front panel.

3. The accordion-like file as claimed in claim 2, wherein said coupling panel includes at least one groove formed therein, and said front panel includes at least one fastener attached to said bottom panel and slidably engaged in said at least one groove of said coupling panel for guiding and for limiting said front panel to slide relative to said coupling panel.

4. The accordion-like file as claimed in claim 2, wherein said coupling panel includes at least one notch formed therein, and said front panel includes at least one fastener attached to said bottom panel and engageable into said at least one notch of said coupling panel for guiding said front panel to slide relative to said coupling panel.

5. The accordion-like file as claimed in claim 2, wherein said front panel includes at least one end flap folded and engaged onto an end portion of said bottom panel for forming a gap between said at least one end flap and said end portion of said bottom panel and for slidably receiving said coupling panel.

6. The accordion-like file as claimed in claim 2, wherein said coupling panel includes at least one groove formed therein, and said rear panel includes at least one fastener attached to said base panel and slidably engaged in said at least one groove of said coupling panel for guiding and for limiting said rear panel to slide relative to said coupling panel.

7. The accordion-like file as claimed in claim 2, wherein said coupling panel includes at least one notch formed therein, and said rear panel includes at least one fastener attached to said base panel and engageable into said at least one notch of said coupling panel for guiding said rear panel to slide relative to said coupling panel.

8. The accordion-like file as claimed in claim 2, wherein said rear panel includes at least one end flap folded and engaged onto an end portion of said base panel for forming a gap between said at least one end flap and said end portion of said base panel and for slidably receiving said coupling panel.

9. The accordion-like file as claimed in claim 1, wherein an anchoring strap includes a base portion secured to said rear panel, a foldable portion foldable relative to said base portion, a buckle attached to said foldable portion of said anchoring strap, and a fastening strap includes a base segment secured to said rear panel, a fastening device attached to said fastening strap, and a fastening segment engageable through said buckle and foldable and engageable with said fastening device for securing said rear panel to said front panel, and for retaining said expandable connecting member between said rear panel and said front panel.

10. The accordion-like file as claimed in claim 9, wherein said front panel includes a slot, said base segment of said fastening strap is engaged through said slot of said front panel and secured to said rear panel.

11. The accordion-like file as claimed in claim 9, wherein a handle includes a slit for slidably receiving said anchoring strap and for slidably attaching said handle onto said anchoring strap.

* * * * *